US012606983B2

(12) United States Patent
Heindl et al.

(10) Patent No.: US 12,606,983 B2
(45) Date of Patent: Apr. 21, 2026

(54) TRENCH CUTTER AND METHOD FOR FORMING A CUT TRENCH IN THE GROUND

(71) Applicant: BAUER Maschinen GmbH, Schrobenhausen (DE)

(72) Inventors: Kristina Heindl, Hohenwart (DE); Johannes Herb, Thierhaupten (DE); Sebastian Soier, Schrobenhausen (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 400 days.

(21) Appl. No.: 18/355,205

(22) Filed: Jul. 19, 2023

(65) Prior Publication Data

US 2024/0035252 A1 Feb. 1, 2024

(30) Foreign Application Priority Data

Jul. 28, 2022 (EP) ..... 22187410

(51) Int. Cl.
*E02F 5/08* (2006.01)
*E02F 3/20* (2006.01)
(Continued)

(52) U.S. Cl.
CPC ..... *E02F 5/08* (2013.01); *E02F 3/205* (2013.01); *E02F 5/14* (2013.01); *E02F 9/2858* (2013.01)

(58) Field of Classification Search
CPC ..... E02F 3/205; E02F 5/08; E02F 5/14; E02F 9/2858
See application file for complete search history.

(56) References Cited

U.S. PATENT DOCUMENTS 3,439,758 A * 4/1969 Petersen ..... E21D 9/104 299/85.2
3,894,587 A * 7/1975 Sourice ..... E02D 17/13 175/96
(Continued)

FOREIGN PATENT DOCUMENTS

CA 2819960 A1 * 1/2014 ..... E02F 5/30
CN 101285310 A * 10/2008 ..... E02F 3/246
(Continued)

OTHER PUBLICATIONS

The extended European search report issued by the European Patent Office on Jan. 18, 2023, which corresponds to European Patent Application No. EP 22187410.0-1005.

*Primary Examiner* — Jamie L McGowan
(74) *Attorney, Agent, or Firm* — Studebaker Brackett PLLC

(57) ABSTRACT

The invention relates to a trench cutter comprising a cutter frame, at least one rotatably drivable cutter wheel, which has cutting teeth on its outer circumference for removing ground material, at least one bearing shield, which is arranged on the underside of the cutter frame and is configured to support the at least one cutter wheel, at least one conveyor box, which has at least one opening for discharging removed ground material and/or for feeding a suspension and is arranged in the region of the at least one bearing shield, wherein the at least one cutter wheel has, on its side facing the bearing shield, at least one flap tooth which can be adjusted between an unfolded position, in which the flap tooth removes ground material below the bearing shield, and a folded position for running past at the bearing shield. According to the invention, it is provided that a conveying side facing the cutter wheel is provided on the conveyor box with at least one opening, past which the cutting teeth and the at least one flap tooth run with no or little distance, wherein a recess is
(Continued)

Figure 1:
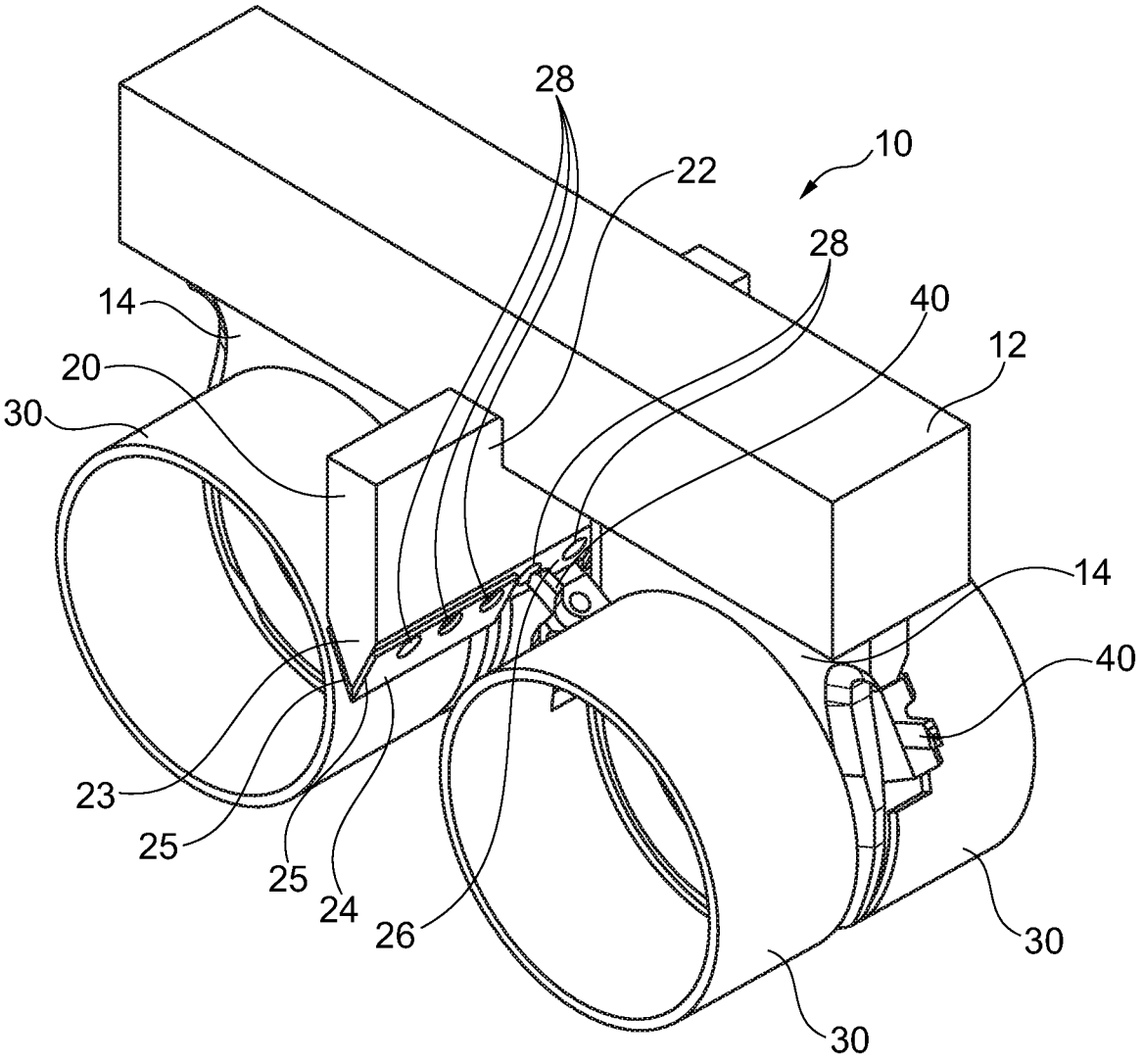

formed on the conveying side with respect to adjacent regions for the at least one flap tooth to run past.

13 Claims, 5 Drawing Sheets

(51) Int. Cl.
*E02F 5/14* (2006.01)
*E02F 9/28* (2006.01)

(56) References Cited

U.S. PATENT DOCUMENTS 4,172,616 A * 10/1979 Delli-Gatti, Jr. ..... E21C 25/10 175/106
4,391,472 A * 7/1983 Krekeler ..... E21C 27/24 175/91
4,718,731 A * 1/1988 Bauer ..... E02F 3/205 299/85.2
4,824,176 A * 4/1989 Barre ..... E02F 3/205 299/59
4,834,197 A * 5/1989 Bauer ..... E02F 3/205 299/85.2
4,844,549 A * 7/1989 Steff de Verninac ... E02F 3/205 175/96
4,875,738 A * 10/1989 Zitz ..... E21C 25/10 175/267
4,883,134 A * 11/1989 Bollinger ..... E02F 3/205 37/189
7,278,228 B2 * 10/2007 Arzberger ..... E02F 3/205 37/447
2015/0322644 A1 * 11/2015 Gillard ..... E02F 3/241 37/195
2019/0323205 A1 * 10/2019 Bernasinski ..... E02F 3/246
2021/0095435 A1 * 4/2021 Domanski ..... E02F 3/961
2022/0056661 A1 * 2/2022 Widmann ..... E02F 3/246
2024/0035252 A1 * 2/2024 Heindl ..... E02F 5/08

FOREIGN PATENT DOCUMENTS

DE 3519774 A1 * 12/1986
DE 3715977 A1 * 12/1988 ..... E02F 9/2808
DE 10 2019 135781 A1 6/2021
DE 102021114947 A1 * 12/2022 ..... E02F 3/205
DE 102021115812 A1 * 12/2022 ..... E02D 17/13
EP 0291027 A1 * 11/1988 ..... E02F 3/205
EP 0 291 027 B1 10/1991
EP 1350893 A1 * 10/2003 ..... E02D 17/13
EP 1 548 192 A1 6/2005
EP 1 548 192 B1 7/2008
EP 2 028 319 A1 2/2009
EP 2369063 A1 * 9/2011 ..... E02F 3/205
EP 4134488 A1 * 2/2023 ..... E02D 17/13
FR 2805552 B1 * 7/2002

* cited by examiner

TRENCH CUTTER AND METHOD FOR FORMING A CUT TRENCH IN THE GROUND

The invention relates to a trench cutter with a cutter frame, at least one rotatably drivable cutter wheel, which is provided with cutting teeth on its circumference, at least one bearing shield, which is arranged on the underside of the cutter frame and is designed to support the at least one cutter wheel, at least one conveyor box, which has at least one opening for discharging removed ground material and/or for feeding a suspension and is arranged in the region of the at least one bearing shield, wherein the at least one cutter wheel has, on its side facing the bearing shield, at least one flap tooth which is adjustable between an unfolded position, in which the flap tooth removes ground material below the bearing shield, and a folded position for running past the bearing shield, according to the preamble of claim 1.

The invention further relates to a method for forming a cut trench in the ground according to the preamble of claim 13.

Generic trench cutters can be found in EP 1 548 192 B1 or EP 0 291 027 B1, for example. In the case of trench cutters with cutter wheels arranged laterally on a bearing shield, there is the problem that ground regions directly below the bearing shield and next to the bearing shield cannot be easily removed by the cutter wheels. For this purpose, so-called flap teeth are arranged on the side of the cutter wheels adjacent to the bearing shield. By means of a cam control, for example, the flap teeth can be unfolded into a region next to and below the bearing shield in order to work off an underlying ground region, while the flap teeth are folded in again when the cutter wheel continues to rotate, so that the bearing shield is not damaged by the cutting teeth.

Furthermore, it is known for trench cutters to arrange a so-called suction box in the region of the bearing shield, preferably between two adjacent bearing shields. Via the suction box, cut ground material together with surrounding suspension can be suctioned-in directly in the region of the cutter wheels and discharged upwards out of the cut trench.

In a so-called CSM™ method, the removed ground material can alternatively remain in the cut trench, wherein suspension can be fed into the region of the cutter wheels via a feed device. Thus, a so-called soil binder can be created in situ in the cut trench with the removed ground material and a supplied cement suspension. The soil binder can remain in the trench after completion of the cutting operation and retraction of the trench cutter from the trench and harden to form a so-called trench wall.

The suction box or a corresponding feed device, which will be referred to collectively as the conveyor box in the following, should be arranged as close as possible to the cutter wheels to ensure good functionality. This allows, on the one hand, reliable suction of removed ground material and, on the other hand, reliable, effective injection of slurry into the region of the cutter wheels. On the other hand, the cutting teeth can pass close to the conveyor box with the at least one opening, so that the at least one opening on the conveyor box is kept free by the cutting teeth and thus the risk of clogging by removed ground material is reduced.

This means that in the known cutter wheels, the flap teeth cannot project radially further than the fixed cutting teeth on the adjacent circumference of the cutter wheel when passing the conveyor box. This limits a length of the flap tooth. This in turn causes that the flap tooth on the cutter wheel must be arranged and designed in such a way that it protrudes at a relatively flat angle in the direction towards the bearing shield in order to remove the ground material below the cutting shield. This is unfavorable with regard to the load on the flap teeth.

In particular, such a position with an flat angle results in that a relatively thick material ridge remains on the ground below the cutting shield. The larger this material ridge of the ground is, the more efficient advance is hindered and the greater the risk of the cutter being deflected or running away from an intended direction of advance. The material ridge can also extend along the side over the entire depth of the cut trench. This represents an impairment and weakening of the created trench wall element in the ground.

The object underlying the invention is to specify a trench cutter and a method with which a particularly efficient creation of a trench in the ground is made possible.

This object is achieved on the one hand by a trench cutter having the features of claim 1 and on the other hand by a method having the features of claim 13. Preferred embodiments are specified in the dependent claims.

The trench cutter according to the invention is characterized in that a conveying side facing the cutter wheel is provided on the conveyor box with the at least one opening, at which the cutting teeth and the at least one flap tooth pass with little or no distance, wherein a recess is formed on the conveying side for passing of the at least one flap tooth. This makes it possible to form the flap tooth with a greater length. The invention is based on the knowledge that an improvement in the creation of a cut trench is achieved by the fact that the flap tooth protrudes at an angle as steep as possible with respect to a center plane of the bearing shield or a direction of advance. The smaller this angle is with respect to a center plane of the bearing shield, the smaller is the remaining material ridge on the ground below the cutting shield.

A setting angle of the flap tooth in the unfolded position can become smaller the greater a length of the flap tooth is. However, the length of the flap tooth is limited by the requirement to run past at an adjacent conveyor box.

One finding of the invention resides in that the conveyor box for the passing of the fixed cutting teeth on the one hand and of the at least one flap tooth on the other hand is not of the same design. Rather, a recess is formed on the conveyor box for the at least one flap tooth to run past in relation to the adjacent regions of the conveyor box, which are provided for the passage of the fixed cutting teeth.

This recess makes it possible to provide a longer flap tooth so that it can, on the one hand, remove the ground material below the cutter blade at a steeper angle and, at the same time, can reliably run past the conveyor box. The passage of the fixed cutting teeth and also of the at least one flap tooth at the conveyor box can take place with a small distance or even with a slight contact of the teeth to the conveyor box, so that the teeth can contribute to keeping the at least one opening at the conveyor box free.

A preferred embodiment of the invention resides in that the at least one flap tooth protrudes radially with respect to fixed cutting teeth when running past the conveying side of the conveyor box. In particular, the flap tooth protrudes radially with respect to adjacent or even all stationary cutting teeth. The degree of radial protrusion corresponds to the depth of the recess on the conveying side of the conveyor box. Depending on the nature of the control path of the at least one flap tooth, it may pass the conveyor box in a folded-in position, an unfolded position, or an intermediate position.

According to a further embodiment variant of the invention, it is preferred that the bearing shield is configured plate-shaped and that a cutter wheel is mounted on each side of the bearing shield for forming a pair of cutter wheels. In this way, a substantially symmetrical load can be achieved on the bearing shield. This is advantageous for the service life of the trench cutter.

According to a further development of the invention, a particularly efficient trench cutter is achieved in that two bearing shields, each with a pair of cutter wheels, are arranged on the underside of the cutter frame. With such an arrangement of a total of four cutter wheels, which are arranged in pairs, trenches with an approximately rectangular cross-section can be created in the ground.

According to one embodiment of the invention, it is particularly expedient that the at least one cutting box is arranged centrally between two bearing shields. The conveyor box, which can be designed as a suction box and/or as a feed device, can thus be arranged in a central position to the total of four cutter wheels. This allows efficient removal of cut ground material or respectively efficient feeding of suspension, for example, when the conveyor box is used for a CSM™ process for producing a soil binder in situ in the cut trench.

According to a further development of the invention, it is particularly expedient that the conveyor box is connected to a suction pump for discharging removed ground material via a suction line. Via the conveyor box, removed ground material can thus be suctioned-in in the region of the cutter wheels and conveyed upwards out of the cut trench. The suction pump can preferably be arranged directly on the cutter frame and/or also on the ground surface. The trench cutter can thus be manufactured, in particular for a two-stage method for creating a cut trench in the ground, whereby in a first stage the trench is created using a supporting liquid, which is then replaced in a second stage by a curable mass. The cut ground material can be processed at the ground surface in a processing plant and then at least partially recycled back into the cut trench to form the curable mass.

According to a further embodiment of the invention, it is preferred that the conveyor box is connected via a feed line to a feed device for feeding a suspension. The feed device can in particular inject suspension under pressure into the region of the cutter wheels. In particular, a suspension can be supplied to process removed ground material directly in situ in the cut trench to form a soil binder. The soil binder may then remain in the ground to form a trench wall. The feed device may include an injection pump. The conveyor box can have an only rudimentary box shape where one or more openings can be designed as a nozzle opening for selective injection of the suspension under pressure.

In principle, the conveyor box can have almost any shape. In particular, when used for suctioning off cut ground material, it is preferred according to one embodiment of the invention that the conveyor box has a wedge-shaped, downward-facing portion with wedge surfaces, which form the conveying side with at least one opening on each sides. The conveyor box can thus have a downward-facing wedge structure, wherein at least one opening is formed on each of the two wedge surfaces angled towards each other, preferably for suctioning-off ground material. The openings thus face the respective cutter wheels and can ensure good discharge of removed ground material or for targeted injection of a suspension into the region of the cutter wheels.

According to one embodiment of the invention, it is particularly expedient that multiple openings are provided on the conveying side. In the case of a wedge-shaped structure, in particular, multiple openings can be provided on each wedge surface. This allows for a particularly efficient discharge or feeding.

According to one embodiment, a particularly robust design of the trench cutter is achieved in that at least one wear plate is arranged on the conveying side and in that, to form the recess, the wear plate has a reduced thickness in the region of the recess or is omitted in this region. The wear plate can be attached to the conveyor box in a substantially detachable manner, in particular by separable weld seams. The recess can be achieved in a particularly simple manner in this way that the wear plate are omitted for the passage of the flap tooth at the conveyor box along the path of travel. Alternatively, the wear plate can be reduced in thickness in this region or a thinner wear plate can be used.

Another advantageous embodiment of the invention resides in that when a pair of cutter wheels is arranged on a bearing shield, a common recess is formed on the conveying side of the conveyor box for the flap teeth of the two cutter wheels. Thus, a central conveyor box can be provided on the trench cutter, wherein a continuous recess is provided, for example, in a central region of the conveyor box on each conveying side. This continuous recess can be used both by the flap tooth on one side of the bearing shield and by the opposite flap tooth on the other side of the bearing shield.

The trench cutter can basically be newly formed or an existing trench cutter can be converted according to the invention. When providing a corresponding recess on a conveyor box, the flap tooth can then be formed to be correspondingly longer. According to one embodiment of the invention, it is particularly advantageous that the at least one flap tooth in its unfolded position has an angle smaller than or equal to 45° relative to a center plane of the bearing shield.

Compared to an existing design, the flap tooth can be extended with the arrangement according to the invention and thus an improved removal of ground material directly below the bearing shield can be achieved in any case. The steeper or smaller the angle of the flap tooth in its unfolded position, the better the soil removal. The length of the flap tooth should always be designed in such a way that the flap tooth in its unfolded position reaches at least as far as a center plane of the bearing shield, so that an underlying ground region can be reliably removed from both sides of a pair of cutter wheels.

The invention further comprises a method for forming a cut trench in the ground, wherein the method is characterized in that at least one of the above-described trench wall cutters according to the invention is used. Here, the above-described advantages in creating a cut trench in the ground can be achieved. In particular, the method can also be used to form a trench wall, wherein a curable mass for creating the trench wall is introduced or formed within the formed cut trench.

Figure 2:
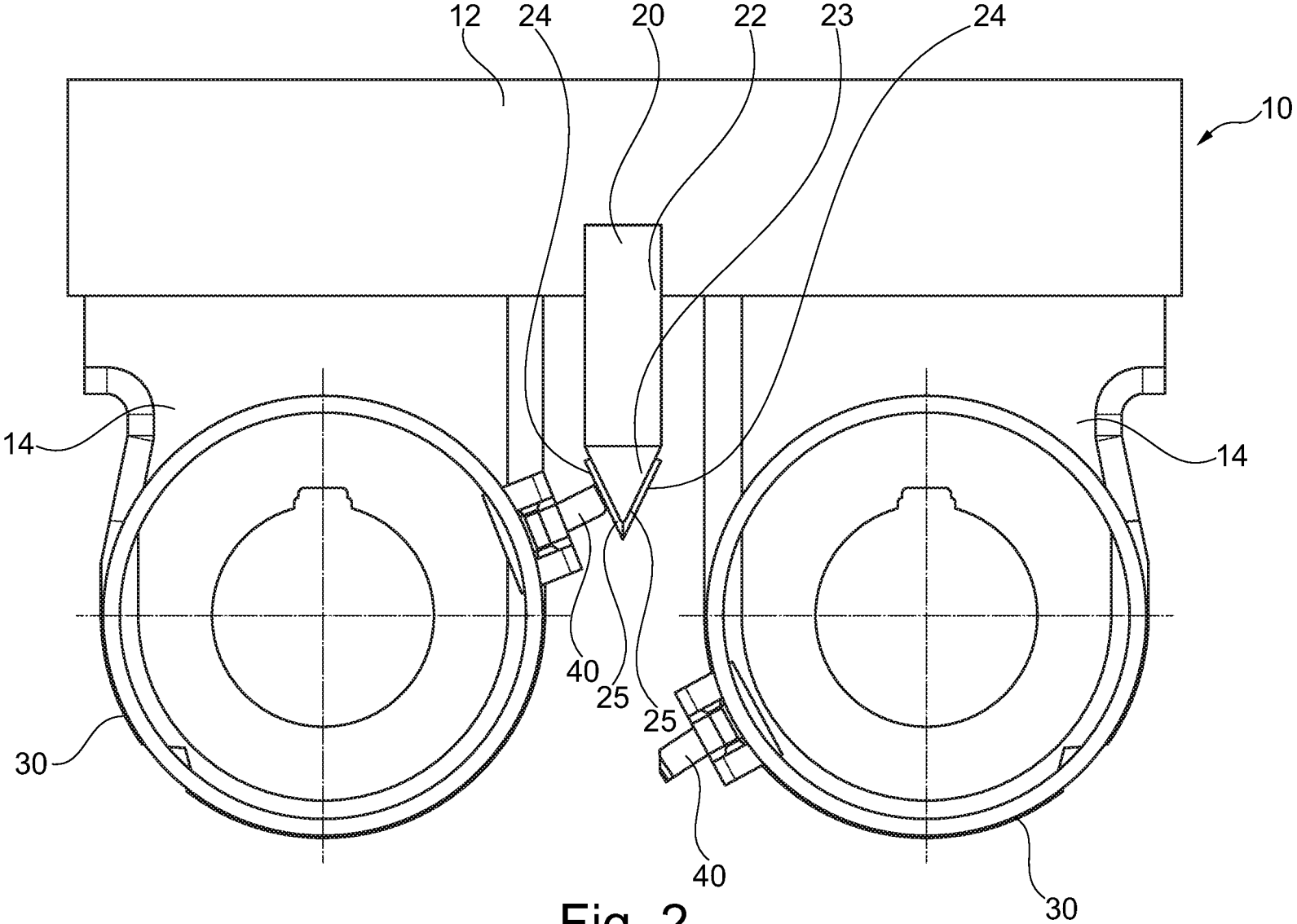
Figure 4:
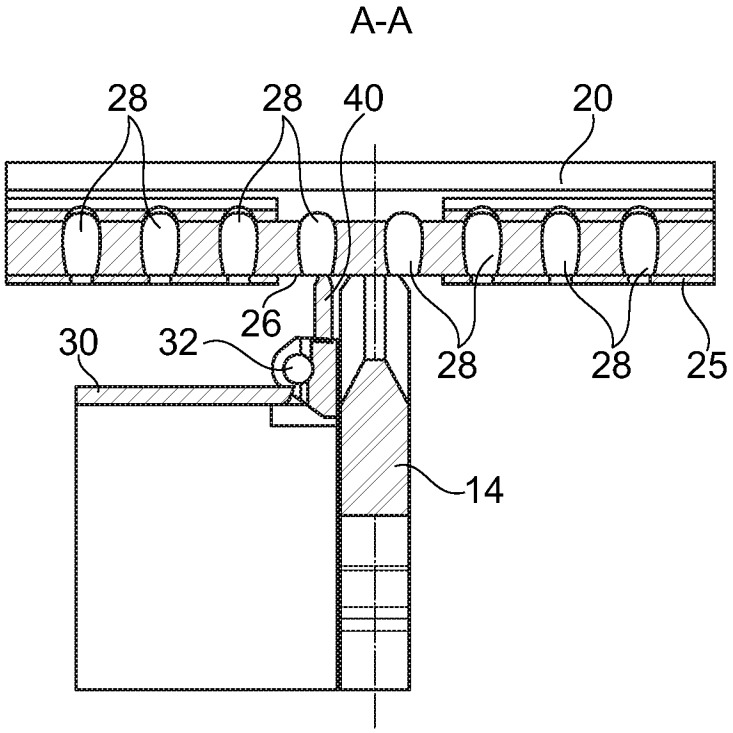
Figure 3:
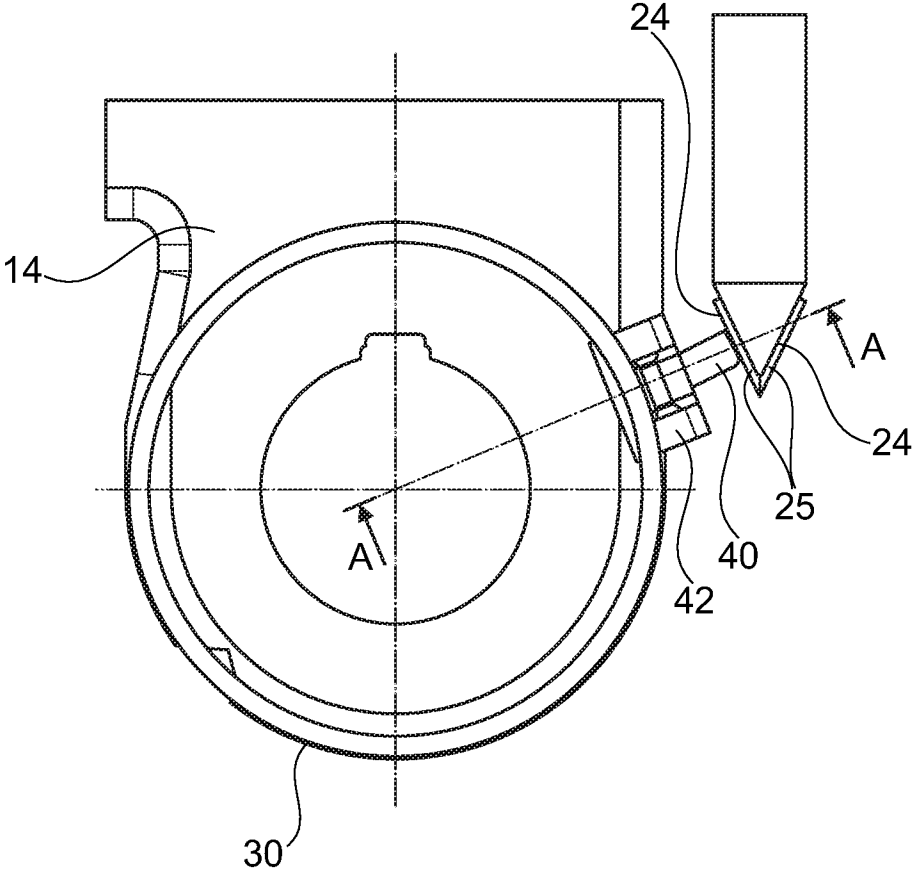
Figure 5:
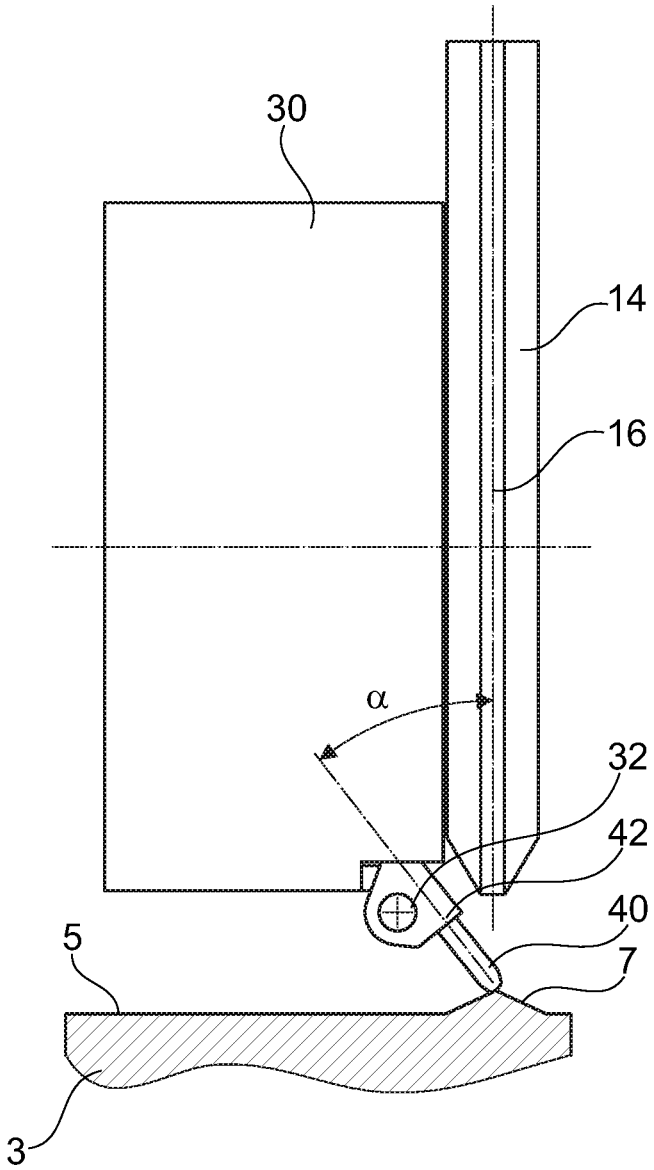
Figure 6:
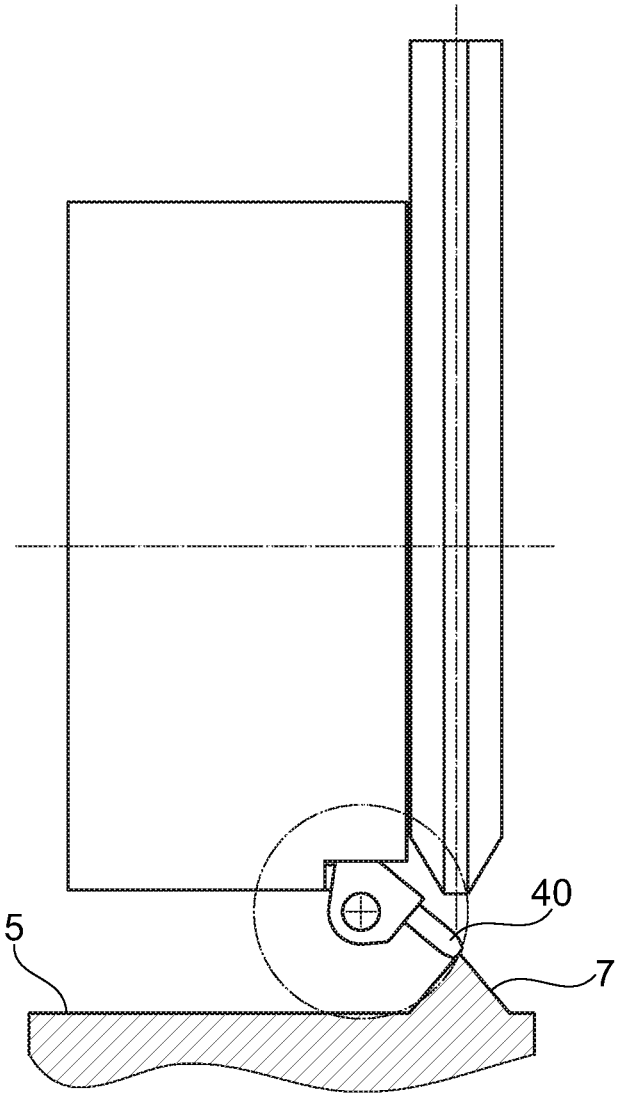

The invention is explained in greater detail below with reference to preferred exemplary embodiments, which are shown schematically in the drawings. Shown are in:

FIG. 1 a schematic perspective view of a lower region of a trench cutter according to the invention;

FIG. 2 a side view of the trench cutter of FIG. 1;

FIG. 3 a detail view of the arrangement of a bearing shield, a flap tooth and a conveyor box;

FIG. 4 a cross-sectional view according to section A-A of FIG. 3;

FIG. 5 a schematic illustration of the trench cutter according to the invention with an unfolded flap tooth and the worked-off ground region; and FIG. 6 an illustration corresponding to FIG. 5 for a conventional trench cutter.

FIGS. 1 and 2 show in a schematic illustration a trench cutter 10 according to the invention with a cutter frame 12 which is only strongly schematically indicated and on the underside of which two bearing shields 14 are arranged next to each other. A cutter wheel 30 can be rotatably mounted on each plate-shaped bearing shield 14 on each side. The cutter wheels 30 are driven in rotation by a drive device, not shown, which may comprise a hub drive inside each of the cutter wheels 30 or a drive motor on the cutter frame 12 with a gear arrangement in the bearing shield 14, for removing ground material. Fixed cutting teeth, not shown, are arranged on the outer circumference of the cutter wheels 30 in a manner known per se.

A conveyor box 20, preferably directed parallel to the axes of the cutter wheels 30, can be arranged between the two bearing shields 14 on the underside of the cutter frame 12. In the illustrated embodiment, the conveyor box 20 comprises a base body 22 with a wedge-shaped, downward-facing portion 23. A conveying side 24 with openings 28 may be arranged on each of the wedge surfaces of the wedge-shaped portion 23. The conveyor box 20 may be designed as a suction box, which can be line-connected to a suction pump, not shown, on the cutter frame 12. Via the openings 28, removed ground material with surrounding liquid can thus be suctioned into the openings 28 and discharged upwards through the cutter frame 12.

According to the invention, a recess 26 is formed on the conveying sides 24 of the conveyor box 20 for flap teeth 40 to run past the cutter wheels 30. In the illustrated exemplary embodiments, the recess 26 is formed by applying a wear plate 25 to the remaining regions of the conveying side 24, which is omitted in the region of the recess 26.

As can be seen particularly well from the side view of FIG. 2, the flap teeth 40 on the cutter wheels 30 are designed in such a way that they protrude into the region of the recess 26 on the conveyor box 20. The flap teeth 40 can be formed with such a length that they run past the conveyor box 20 at the bottom of the recess 26 with a small distance, which is preferably smaller than a thickness of the wear plate 25, or, in particular contact and scratch it slightly. In this way, the openings 28 in the region of the recess 26 can be kept free from clogging, for example by rock material, by the flap teeth 40. The conveying teeth, not illustrated, on the cutter wheels 30 may be designed with a corresponding fixed length so that they run past at the protruding wear plates 25 with a corresponding small clearance or also contact and scratch them easily.

This arrangement and configuration of the flap teeth 40 is particularly apparent from FIGS. 3 and 4. In particular, in FIG. 4, the flap tooth 40, which may be received in a tooth holder 42 that is pivotally mounted on the cutter wheel 30 about a pivot axis 32, is shown in a folded position in which the flap tooth 40 is aligned and spaced apart from the bearing shield 14. In this folded position, the flap tooth 40 can slightly contact the bottom of the recess 26 on the conveyor box 20 to clear the opening 28 in the region of the recess 26 when the cutter wheels 30 are rotated.

Due to the recess 26 provided on the conveyor box 20 according to the invention, the flap tooth 40 can be formed with a greater length. According to FIG. 5, a flap tooth designed according to the invention is shown in its unfolded position on the cutter wheel 30, whereby the flap tooth 40 can remove ground material below the bearing shield 14 and assumes an angle a with respect to a center plane 16 of the bearing shield 14. Depending on the length of the flap tooth 40, a material ridge 7 remains below the bearing shield 14 at the cutting base 5 of the ground 3. This also extends across the cutting cross section up into the side wall of the cut trench. In its unfolded position according to FIG. 5, the flap tooth 40 should extend at least as far as the center plane 16 of the bearing shield 14, since the opposite bottom region is removed by the flap tooth 40 of the opposite cutter wheel 30, which is not shown in FIG. 5. The longer the flap tooth 40, the smaller the setting angle a relative to the center plane 16 and the smaller and flatter the remaining material ridge 7 on the cutting base 5 and correspondingly on the side wall.

This becomes clear in comparison with the schematic illustration of a conventional trench cutter according to FIG. 6. The illustration according to FIG. 6 corresponds in principle to the illustration of FIG. 5, but wherein a conventional flap tooth 40 is designed shorter. The material ridge 7 remaining on the cutting base 5 is correspondingly larger and more solid in the case of a conventional trench cutter.

The invention claimed is:

1. Trench cutter, comprising
- a cutter frame,
- at least one rotatably drivable cutter wheel, which has cutting teeth on its outer circumference for removing ground material,
- at least one bearing shield, which is arranged on the underside of the cutter frame and is configured to support the at least one cutter wheel,
- at least one conveyor box, which has at least one opening for discharging removed ground material and/or for feeding a suspension and is arranged in the region of the at least one bearing shield,
- wherein the at least one cutter wheel has at least one flap tooth on its side facing the bearing shield, which flap tooth is adjustable between an unfolded position, in which the flap tooth removes ground material below the bearing shield, and a folded position for running past the bearing shield, wherein the conveyor box has a conveying side facing the cutter wheel, the conveying side including the at least one opening, past which the cutting teeth and the at least one flap tooth run with no or little distance, the conveying side also including a recess with respect to adjacent regions of the conveying side, and wherein the recess and at least one flap tooth are arranged such that the flap tooth protrudes into the recess and runs past the conveyor box at a bottom of the recess.

2. Trench cutter according to claim 1, wherein the at least one flap tooth protrudes radially with respect to fixed cutting teeth when running past at the conveying side of the conveyor box.

3. Trench cutter according to claim 1, wherein the bearing shield is configured plate-shaped, and in that a cutter wheel is mounted on each side of the bearing shield for forming a pair of cutter wheels.

4. Trench cutter according to claim 3, wherein two bearing shields, each with a pair of cutter wheels, are arranged on the underside of the cutter frame.

5. Trench cutter according to claim 1, wherein the at least one conveyor box is arranged centrally between two bearing shields.

6. Trench cutter according to claim 1, wherein the conveyor box is connected to a suction pump for discharging removed ground material via a suction line.

7. Trench cutter according to claim 1,
wherein the conveyor box is connected to a feed device for feeding a suspension via a feed line.

8. Trench cutter according to claim 1,
wherein the conveyor box has a wedge-shaped, downward-facing portion with wedge surfaces which form the conveying side on both sides with at least one opening in each case.

9. Trench cutter according to claim 1,
wherein multiple openings are provided on the conveying side.

10. Trench cutter according to claim 1,
wherein at least one wear plate is arranged on the conveying side, and
in that, in order to form the recess, the wear plate has a reduced thickness in the region of the recess or is omitted in this region.

11. Trench cutter according to claim 1,
wherein when a pair of cutter wheels is arranged on a bearing shield, a common recess is formed on the conveying side of the conveyor box for the flap teeth of the two cutter wheels.

12. Trench cutter according to claim 1,
wherein the at least one flap tooth, in its unfolded position, has an angle smaller than or equal to 45° relative to a center plane of the bearing shield.

13. Method for forming a cut trench in the ground,
wherein a trench cutter according to claim 1 is used.

* * * * *